US006417782B1

(12) United States Patent
Darnall

(10) Patent No.: US 6,417,782 B1
(45) Date of Patent: Jul. 9, 2002

(54) DRIVER'S EMERGENCY ALERT SYSTEM

(76) Inventor: Larry Dean Darnall, 1412 Princeton, O'Fallon, IL (US) 62269

( * ) Notice: Subject to any disclaimer, the term of this patent is extended or adjusted under 35 U.S.C. 154(b) by 0 days.

(21) Appl. No.: 09/602,094

(22) Filed: Jun. 22, 2000

(51) Int. Cl.[7] ..... G08G 1/00

(52) U.S. Cl. ..... 340/902; 340/435; 340/436; 340/904; 455/404

(58) Field of Search ..... 340/435, 436, 340/902, 904; 455/404

(56) References Cited

U.S. PATENT DOCUMENTS 5,307,060 A * 4/1994 Prevulsky et al. ..... 340/902
5,311,197 A 5/1994 Sorden et al.
5,565,874 A 10/1996 Rode
5,808,560 A * 9/1998 Mulanax ..... 340/902
5,926,112 A * 7/1999 Hartzell ..... 340/902
6,087,961 A * 7/2000 Markow ..... 340/902
6,094,148 A * 7/2000 Henry et al. ..... 340/902
6,160,493 A * 12/2000 Smith ..... 340/902

* cited by examiner

*Primary Examiner*—Daniel J. Wu
(74) *Attorney, Agent, or Firm*—Anthony R. Johnson

(57) ABSTRACT

The specification relates to a method for alerting a personal, moving vehicle of an approaching emergency vehicle comprising trarnsmitting an emergency signal from an emergency vehicle, receiving the emergency signal in a personal vehicle, and alerting the driver of the personal vehicle that the emergency vehicle is approaching; and the underlying process for an Emergency Alert System comprising a transmitting means located in an emergency vehicle for transmitting an emergency signal indicating that the emergency vehicle is approaching, a receiving means located in a personal vehicle for receiving the emergency signal from the transmitting means, and an alert means triggered by the receiving means to alert the driver of the personal vehicle that the emergency vehicle is approaching.

7 Claims, 2 Drawing Sheets

DRIVER'S EMERGENCY ALERT SYSTEM

BACKGROUND OF THE INVENTION

1. Field of the Invention

This invention is concerned with an improvement in an emergency system for alerting personal, moving vehicles of approaching emergency vehicles.

The current invention is concerned with the protection of the common motorist on the road when an emergency vehicle is approaching on its way to an emergency sight or to a medical provider. Emergency vehicles include police vehicles, fire trucks and paramedic vehicles. The invention is also concerned with the safety of the emergency vehicle's passengers as it drives through the common roadways. The invention is also concerned with protecting motorists from potential collisions with the emergency vehicles. It is a public policy, and certainly a public benefit, to have a path cleared for the emergency vehicle as it is approaching the emergency sight or medical provider. When emergency vehicles are responding to an emergency, they do not follow all of the normal routes, procedures and speed limits. Motorists unaware of an approaching emergency vehicle are at a high risk to cause or be involved in an accident as the emergency vehicle is approaching or passing by the motorist. The current invention will minimize such risk. The invention will increase the emergency vehicle's experience of a clear, unobstructed path. Such a path will help to reduce any collisions and accidents involving the emergency vehicle or other motorists around the emergency vehicle. Furthermore, response time to emergencies is critical. The current invention will foster a quicker response time by the emergency vehicle to the emergency sight and to the medical provider.

Currently, many emergency vehicles are equipped with a transmitting unit, the Global Positioning System (commonly and herein referred to as "GPS"). A GPS signaling unit is mounted on the dashboard of the emergency vehicle. The GPS signaling unit sends a signal to traffic lights in the emergency vehicle's path. The emergency vehicle can then clear the path for itself by turning the signals in its path green while turning the cross traffic signals red. The current GPS signaling unit is mounted on the dashboard of the emergency vehicle. In contrast, the current invention, the Driver's Emergency Alert System, would utilize a receiving unit located in the personal vehicle which would receive a signal from the approaching emergency vehicle, thereby alerting the driver of the personal vehicle of the approaching emergency vehicle.

In the current invention, the receiver in the personal vehicle could be mounted virtually anywhere in the personal vehicle, could be programmed to receive signals from the current GPS transmissions or could use an entirely different technology. Upon receiving the signal, the personal vehicle's receiving unit would then activate an alert system within the personal vehicle, of either an auditory and/or visual nature, such as activating the door chimes, a dedicated alarm for such emergencies, the vehicle's current lights, or a dedicated light(s) or indicator(s) for such emergencies. Such alert would allow the driver of the personal vehicle time to pull out of the way of the emergency vehicle. Thus the invention will increase safety and response time to emergencies, and thereby save lives.

2. Related Prior Art

It is known that 3M Transportation Systems has a system entitled the Opticom Priority Control System or other similar title. This system provides a method of turning intersection lights green in the path of oncoming emergency vehicles, providing the safest and quickest avenue for the emergency vehicle to reach the emergency scene or medical provider. It enables the emergency vehicle driver to control the intersections by controlling the lights in the emergency vehicle's path and the lights of the cross traffic cutting across the emergency vehicle's path.

The Opticom Priority Control System basically works with three components: First, an emitter (first component) is mounted on the emergency vehicle, usually on its roof. It sends a coded optical message to the detector (second component), mounted above the traffic signal. The detector converts the optical message to an electronic impulse and sends it to the phase selector (third component) in the intersection controller cabinet. If the traffic light is already green, the phase selector tells the controller to hold the light green until the emergency vehicle passes. If the traffic light is red, the phase selector requests the controller to provide an early green traffic light, cycling through a yellow light to avoid any confusion to motorists and pedestrians. Once the emergency vehicle passes through the intersection, the system returns the traffic signal to its normal operation. Such a system has been installed in more than 35,000 intersection across the United States and Canada, and has earned a track record over years of sustained quality performance.

However, to date, despite the years of using the above system, no invention has been invented which gives a signal and an alert directly to the personal moving vehicles surrounding the emergency vehicle. Today, such a system has been invented by Applicant.

The Sorden Patent, U.S. Pat. No. 5,311,197, teaches a vehicle location system.

The Rode Patent, U.S. Pat. No. 5,565,874, teaches an Intelligent Vehicle Highway System for controlling vehicles moving down the road and refers to issues pertaining to the Global Positioning System and infrared technology.

SUMMARY OF THE INVENTION

It has now been discovered that an emergency alert system may be implemented that signals any personal vehicle; that is, one owned by any private citizen; that an emergency vehicle, such as an ambulance or fire truck is approaching. Thus, in accordance with a first embodiment of the invention, Applicant has discovered a method for alerting a personal vehicle of an approaching emergency vehicle comprising transmitting an emergency signal from the emergency vehicle, receiving the emergency signal in the personal vehicle, and alerting the driver of the personal vehicle that the emergency vehicle is approaching; and the underlying process for an Emergency Alert System comprising a Transmitting Means located in an emergency vehicle for transmitting an Emergency Signal indicating that the emergency vehicle is approaching, a Receiving Means located in a personal vehicle for receiving the Emergency Signal from the Transmitting Means, and an Alert Means triggered by the Receiving Means to alert the driver of the personal vehicle that the emergency vehicle is approaching.

There are several objects of this invention. One object of the invention is to protect motorists from potential collisions with emergency vehicles. When emergency vehicles are responding to an emergency, they do not follow all of the normal routes, procedures and speed limits. Motorists unaware of an approaching emergency vehicle are at a high risk to cause or be involved in an accident as the emergency vehicle is approaching or passing by the motorist. The invention will minimize such risk. A further object of the invention is to allow emergency vehicles a clear, unobstructed path. Such a path will help to reduce any collisions and accidents involving the emergency vehicle or other motorists around the emergency vehicle. A further object of the invention is to foster a quicker response time by the emergency vehicle to the emergency sight.

BRIEF DESCRIPTION OF THE DRAWING(S)

Figure 1:
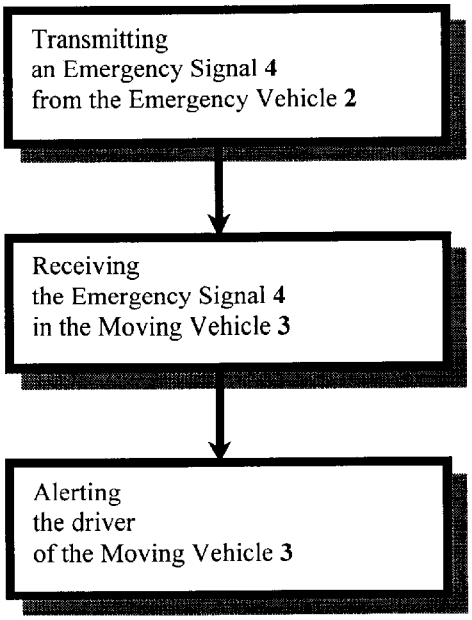
FIG. 1 is a Block Diagram depicting a first embodiment of the process invention, as claimed in claim 1.
Figure 2:
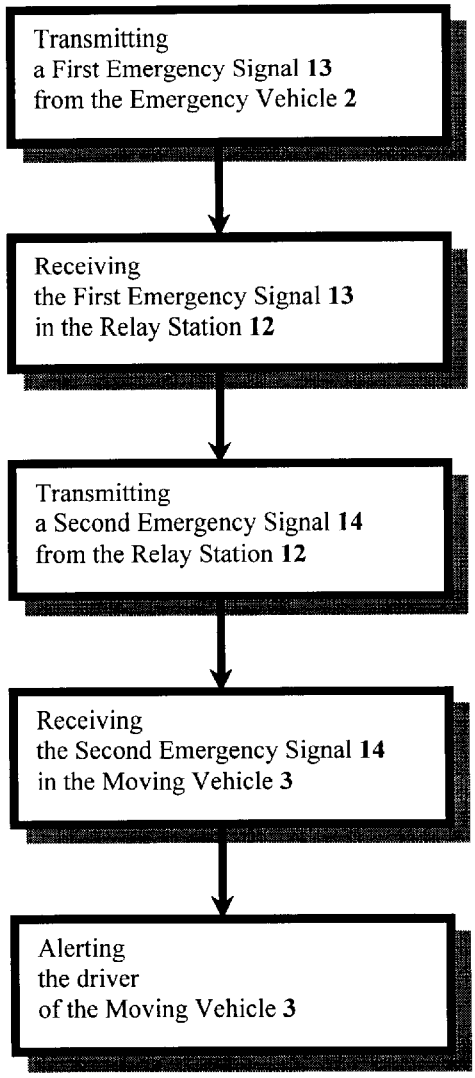
FIG. 2 is a Block Diagram depicting a first embodiment of the process invention, as claimed in claim 2.
Figure 3:
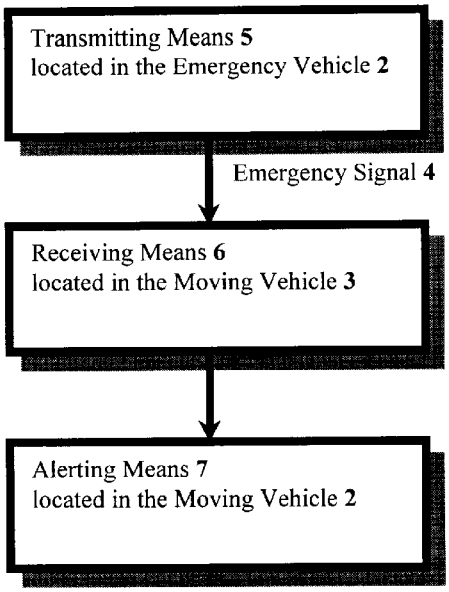
FIG. 3 is a Block Diagram depicting a means plus function diagram of a first embodiment of the process invention, as claimed in claim 7.
Figure 4:
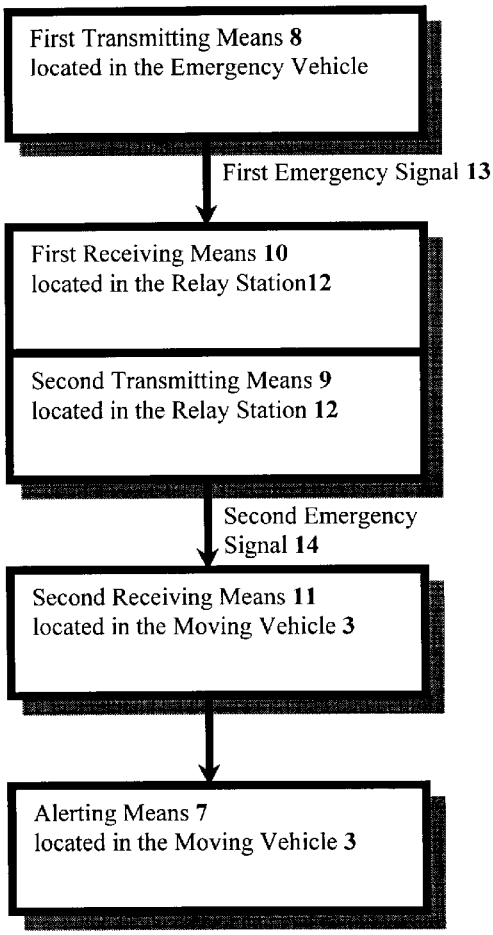
FIG. 4 is a Block Diagram depicting a means plus function diagram of a second embodiment of the process invention, as claimed in claim 8.

In the drawings and in this Specification, the following designations are used:

Emergency Alert System 1
Emergency Vehicle 2
Moving Vehicle 3 or Personal Vehicle 3
Emergency Signal 4
Transmitting Means 5
Receiving Means 6
Alerting Means 7
First Transmitting Means 8
Second Transmitting Means 9
First Receiving Means 10
Second Receiving Means 11
Relay Station 12
First Emergency Signal 13
Second Emergency Signal 14

DESCRIPTION OF THE PREFERRED EMBODIMENT(S)

It has now been discovered that an Emergency Alert System 1 may be implemented that signals any Personal Vehicle 3; that is, one owned by any private citizen; that an Emergency Vehicle 2, such as an ambulance or fire truck is approaching. Thus, in accordance with a first embodiment of the invention, Applicant has discovered a method for alerting a Personal Vehicle 3 of an approaching Emergency Vehicle 2 comprising transmitting an Emergency Signal 4 from an Emergency Vehicle 2, receiving the Emergency Signal 4 in a Personal Vehicle 3, and alerting the driver of the Personal Vehicle 3 that the Emergency Vehicle 2 is approaching.

In the preferred embodiment, the Emergency Alert System 1 comprises a Transmitting Means 5 located in an Emergency Vehicle 2 for transmitting an Emergency Signal 4 indicating that the Emergency Vehicle 2 is approaching, a Receiving Means 6 located in a Personal Vehicle 3 for receiving the Emergency Signal 4 from the Transmitting Means 5, and an Alert Means 7 triggered by the Receiving Means 6 to alert the driver of the Personal Vehicle 3 that the Emergency Vehicle 2 is approaching.

The preferred embodiment of the process consists of transmitting an Emergency Signal 4 from the Emergency Vehicle 2; receiving the Emergency Signal 4 in the Moving Vehicle 3; and alerting the driver of the Moving Vehicle 3 that the Emergency Vehicle 2 is approaching.

In a further embodiment of the invention, the Emergency Alert System 1 comprises a First Transmitting Means 8 located in the Emergency Vehicle 2 for transmitting a First Emergency Signal 13 indicating that the Emergency Vehicle 2 is approaching; a First Receiving Means 10 located in a Relay Station 12 for receiving the First Emergency Signal 13 from the First Transmitting Means 8; and a Second Transmitting Means 9 located in the Relay Station 12 for transmitting a Second Emergency Signal 14 indicating that the Emergency Vehicle 2 is at a particular location; a Second Receiving Means 11 located in the Moving Vehicle 3 for receiving the Second Emergency Signal 14 from the Relay Station 12; and an Alerting Means 7 triggered by the Second Receiving Means 11 to alert the driver of the Moving Vehicle 3 that the Emergency Vehicle 2 is approaching.

Such further embodiment of the process consists of transmitting the First Emergency Signal 13 from the Emergency Vehicle 2; receiving the First Emergency Signal 13 in a Relay Station 12; transmitting a Second Emergency Signal 14 from the Relay Station 12; receiving the Second Emergency Signal 14 in the moving vehicle 3; and alerting the driver of the Moving Vehicle 3 that the Emergency Vehicle 2 is approaching.

In a specific embodiment of the invention, the transmission and reception of the emergency signals, including the Emergency Signal 4, the First Emergency Signal 13 and the Second Emergency Signal 14, could be accomplished by utilizing Global Position System Technology. That is, the Transmitting Means 5, the Receiving Means 6, the First Transmitting Means 8, the Second Transmitting Means 9, the First Receiving Means 10, and the Second Receiving Means 11 would all utilize Global Position System Technology.

In a further embodiment of the invention, the Relay Station 12 is a satellite. Hence, the First Receiving Means 10 and the Second Transmission Means 9 are located in or on the satellite.

In a certain embodiment of the invention, the Alerting Means 7 consists of an Auditory Alert, including the sounding of the Moving Vehicle's 3 door chime and the sounding of an additional Auditory Alarm present for the sole purpose of alerting the driver of the Moving Vehicle 3 that the Emergency Vehicle 2 is approaching, and also consists of a Visual Alert, including the lighting of all or some of the lights already present in the Moving Vehicle 3, and the lighting of an additional Visual Display present solely for the purpose of alerting the driver of Moving Vehicle 3 of the approaching Emergency Vehicle 2.

Having set forth the general nature and specific embodiments of the present invention, the true scope is now particularly pointed out in the appended claims.

What is claimed is:

1. A method for alerting a moving vehicle of an approaching emergency vehicle comprising:

transmitting a first emergency signal from an emergency vehicle;

receiving the first emergency signal in a relay station;

transmitting a second emergency signal from the relay station;

receiving the second emergency signal in the moving vehicle; and alerting the driver of the moving vehicle that the emergency vehicle is approaching.

2. A method for alerting a moving vehicle of an approaching emergency vehicle according to claim 1 wherein:

the transmission and reception of the emergency signals, including the emergency signal, the first emergency signal and the second emergency signal, is accomplished by utilizing Global Position System Technology.

3. A method for alerting a moving vehicle of an approaching emergency vehicle according to claim 1 wherein:

the transmission and reception of the first emergency signal and the second emergency signal is accomplished by utilizing Global Position System Technology;

and the relay station is a satellite.

4. A method for alerting a moving vehicle of an approaching emergency vehicle according to claim 1 wherein:

the transmission and reception of the first emergency signal and the second emergency signal, is accomplished by utilizing Global Position System Technology;

the relay station is a satellite; and alerting the driver is accomplished by an Auditory Alert, including the sounding of the door chime and sounding of an additional Auditory Alarm, and is also accomplished by a Visual Alert, including the lighting of all or some of the lights already present in the personal vehicle, and the lighting of an additional Visual Display solely for the purpose of alerting the driver of personal vehicle driver of approaching emergency vehicle.

5. An Emergency Alert System comprising:

a First Transmitting Means located in an Emergency Vehicle for transmitting a First Emergency Signal indicating that the Emergency Vehicle is approaching;

a Relay Station having a First Receiving Means for receiving the First Emergency Signal, and having a Second Transmitting Means being capable of transmitting a Second Emergency Signal indicating that the Emergency Vehicle is at a particular location;

a Second Receiving Means located in a Moving Vehicle for receiving the Second Emergency Signal; and an Alerting Means triggered by the Second Receiving Means to alert the driver of the Moving Vehicle that the Emergency Vehicle is approaching.

6. The Emergency Alert System according to claim 5 wherein the First Transmitting Means, the First Receiving Means, the Second Transmitting Means, the Second Receiving Means, the First Emergency Signal, the Second Emergency Signal, and the Relay Station utilize the Global Position System Technology; and the Relay Station is a satellite.

7. The Emergency Alert System according to claim 5 wherein the First Transmitting Means, the First Receiving Means, the Second Transmitting Means, the Second Receiving Means, the First Emergency Signal, the Second Emergency Signal, and the Relay Station utilize the Global Position System Technology; and the Relay Station is a satellite; and the Alerting Means consists of an Auditory Alert, including the sounding of the door chime and the sounding of an additional Auditory Alarm, and also consists of a Visual Alert, including the lighting of all or some of the lights already present in the personal vehicle, and the lighting of an additional Visual Display solely for the purpose of alerting the driver of personal vehicle driver of approaching emergency vehicle.

* * * * *